United States Patent [19]

Garver

[11] 4,124,082

[45] Nov. 7, 1978

[54] METHOD OF AND APPARATUS FOR CUTTING A TUNNEL IN PLASTIC SOIL

[76] Inventor: Curtis M. Garver, 3701 Kirby - Suite 1236, Houston, Tex. 77006

[21] Appl. No.: 805,341

[22] Filed: Jun. 10, 1977

[51] Int. Cl.[2] ..... E02D 7/06; E21C 19/00; F16L 1/02

[52] U.S. Cl. ..... 175/62; 175/20; 175/161; 405/184

[58] Field of Search ..... 175/62, 19–22, 175/161; 61/54, 53.5, 72.7, 72.5; 166/50

[56] References Cited

U.S. PATENT DOCUMENTS

| | | | |
|---|---|---|---|
| 2,325,565 | 7/1943 | Williams | 175/62 X |
| 2,599,989 | 6/1952 | Haston | 175/62 X |
| 2,798,692 | 7/1957 | Thomas | 175/62 X |
| 3,026,950 | 3/1962 | Johnson | 175/161 |
| 3,303,657 | 2/1967 | McConnell et al. | 61/72.7 |
| 3,307,643 | 3/1967 | Ferri | 175/161 |
| 3,482,641 | 12/1969 | Atkins | 175/19 |
| 3,656,563 | 4/1972 | Blinne | 175/22 |
| 3,833,075 | 9/1974 | Bachman et al. | 175/20 |

*Primary Examiner*—Stephen J. Novosad
*Attorney, Agent, or Firm*—Lowe, King, Price & Becker

[57] ABSTRACT

The disclosed method of cutting a tunnel in plastic soil uses a pipe and a cutting head mounted on one end of the pipe. The inner diameter of the cutting head is less than the inner diameter of the pipe, and the outer diameter of the cutting head is greater than the outer diameter of the pipe. The method comprises the steps of (1) driving the pipe into plastic soil, cutting head first; (2) providing a lubricating flow of water on both the outside and the inside of the pipe adjacent to the cutting head; (3) withdrawing the pipe from the plastic soil in the opposite direction to the direction in which it was inserted; (4) raising the pipe and swinging to dumping area; and (5) suspending the pipe in the air with the cutting head uppermost in order to allow the soil within the pipe to slide out.

10 Claims, 10 Drawing Figures

Fig. 1
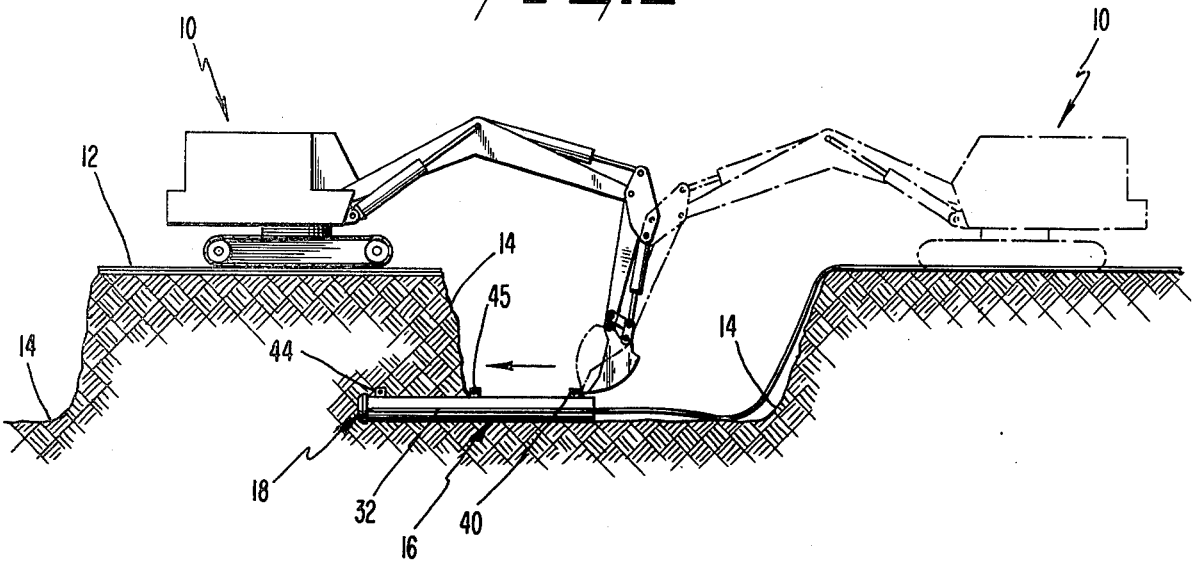
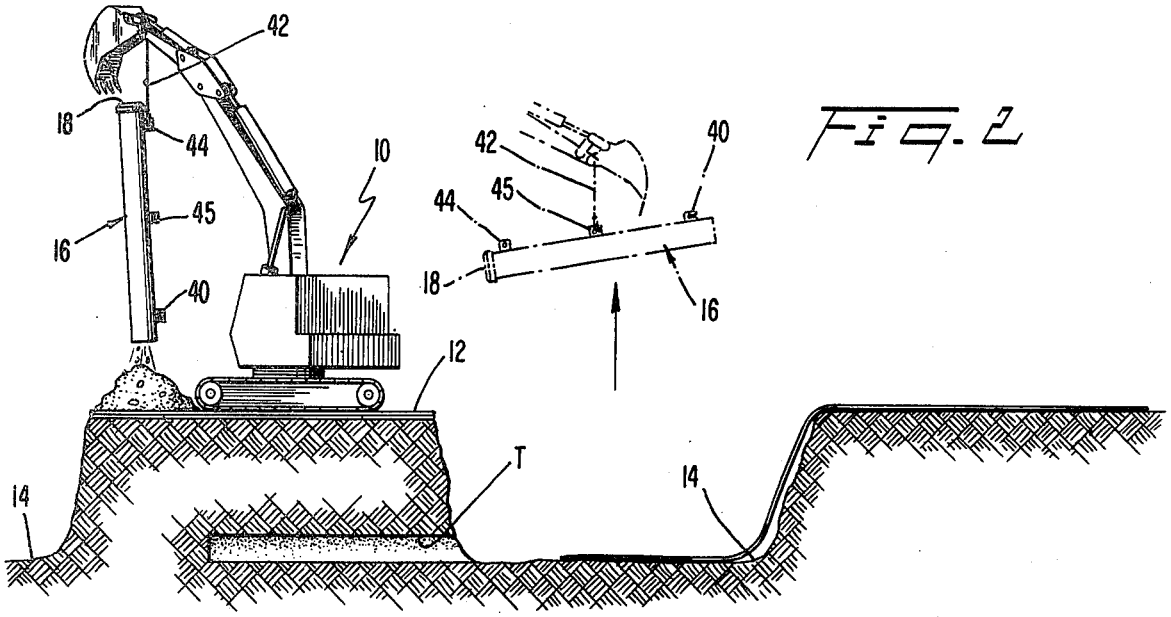
Fig. 2
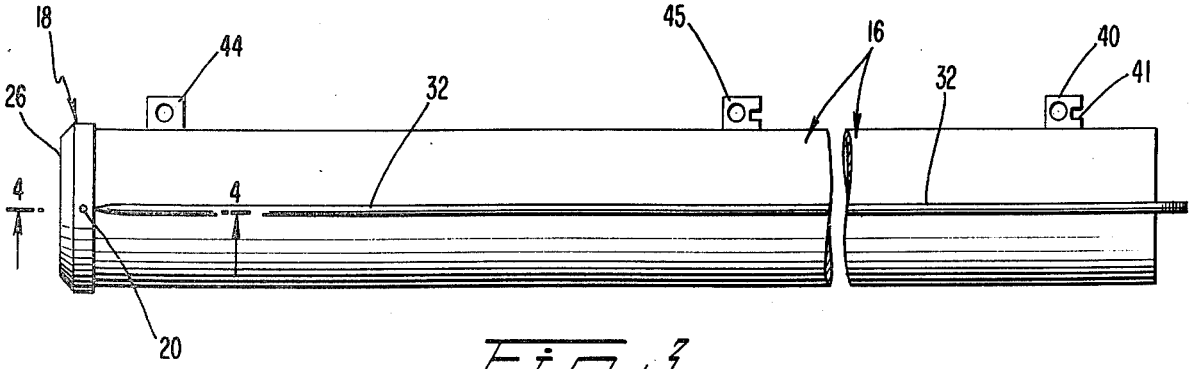
Fig. 3

Fig. 4
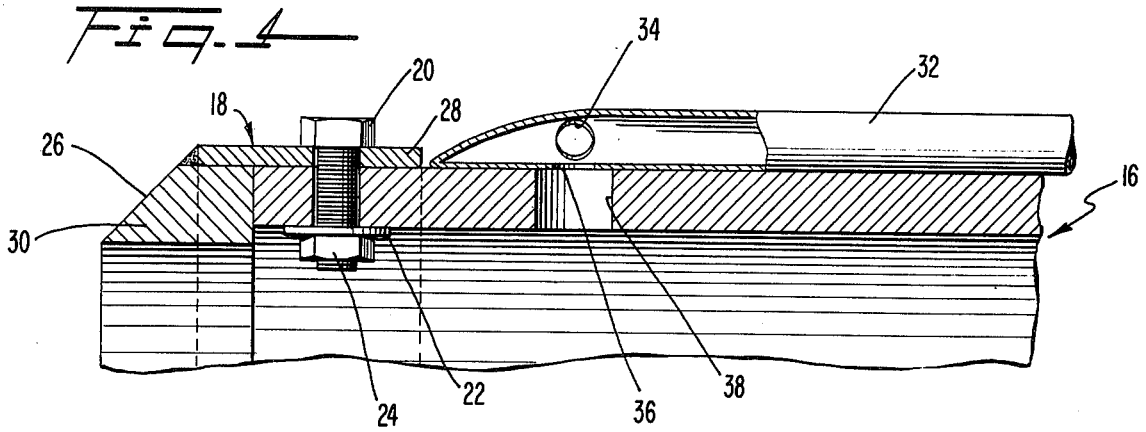
Fig. 5
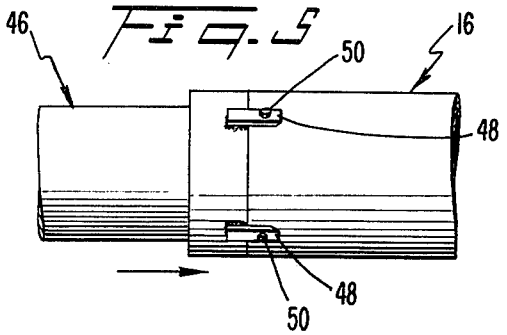
Fig. 6
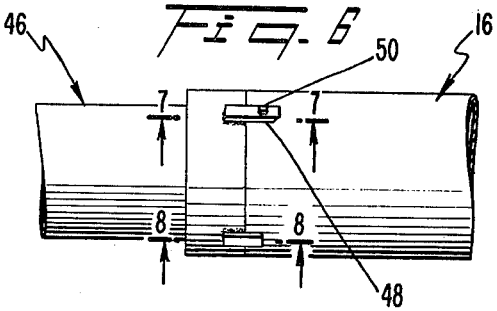
Fig. 7
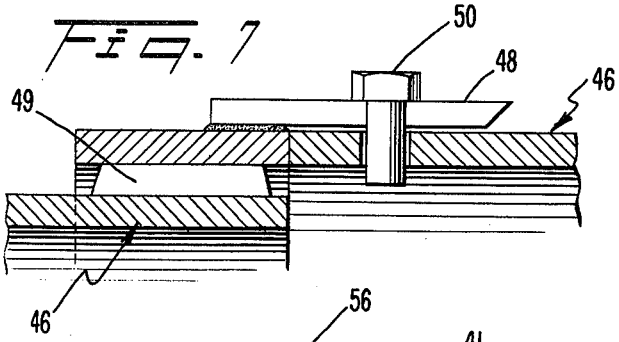
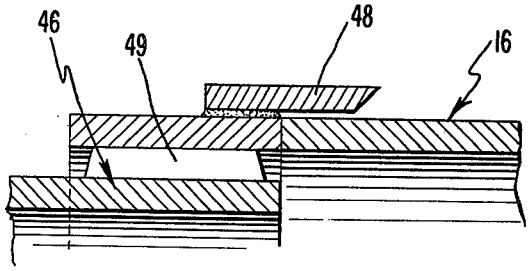
Fig. 8
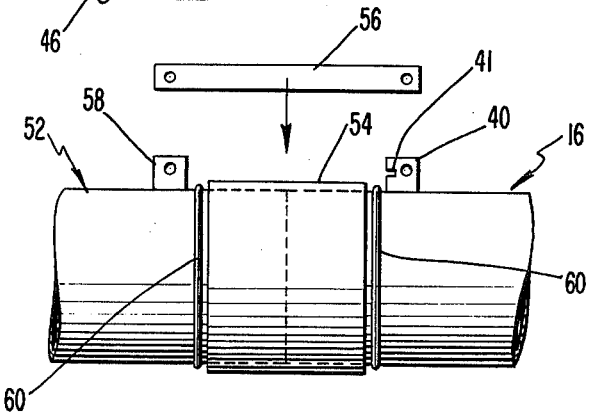
Fig. 9
Fig. 10
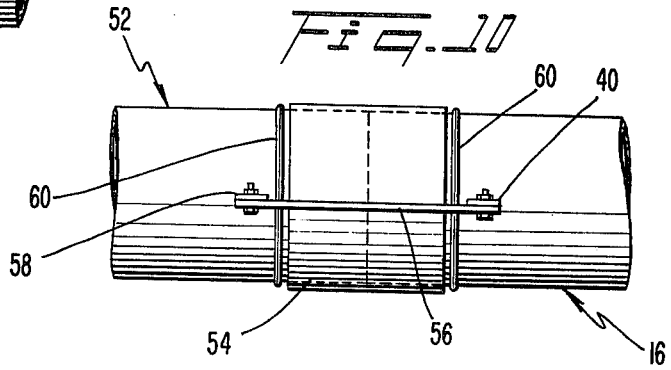

METHOD OF AND APPARATUS FOR CUTTING A TUNNEL IN PLASTIC SOIL

BACKGROUND OF THE INVENTION

This invention relates to a method of and apparatus for cutting a tunnel in plastic soil. The method and apparatus may, for instance, be used to cut a tunnel for a water line or drainage culvert underneath a roadway.

Various methods of and apparatus for cutting tunnels, including tunnels in plastic soil, are of course known already. Typically, they are quite elaborate, and the apparatus is expensive to manufacture, to maintain, and to use. In addition, many of the known methods can only be practiced safely and efficiently by highly skilled workmen.

Specifically, the most prevalent prior art method of which I am aware incorporates use of an expensive auger drilling rig. The rig requires a large excavation, both in width and length, adjacent the roadway, sidewalk or the like under which the tunnel is being bored. A large auger is driven by a separate motor and large quantities of water are used to help wash the dirt out of the tunnel. This prior method is generally recognized as being wasteful of energy since the separate motor is required. It is laboriously slow and is considered dangerous to operate by many because the large rotating auger must be serviced frequently and workmen are sometimes caught in the rotating mechanism.

Accordingly, a replacement method of and apparatus for cutting tunnels in plastic soil which would be inexpensive to manufacture and to maintain and which could be practiced safely and efficiently by relatively unskilled workmen has long been sought.

SUMMARY OF THE INVENTION

Accordingly, my new method and apparatus utilizes the concept of driving a pipe with a cutter head into the soil to from a core inside the pipe and then removing the pipe to dump the dirt of the core. Advantageously, it has been found that the core formed in the pipe is most easily dumped from the end opposite the cutting end, making this method and apparatus highly efficient in use.

The driving step is carried out simply by use of a backhoe, which is readily available at any pipeline construction site. A small volume, lubricating flow of water can be used to minimize friction and additional, smaller diameter extension sections of pipe may be attached for longer tunnels.

BRIEF DESCRIPTION OF THE DRAWINGS

FIG. 1 is an overall side view of the apparatus in the pipe laying environment according to the subject invention with the tunneling pipe being driven into plastic soil (clay or the like) under a roadway;

FIG. 2 is an overall side view according to the subject invention with the pipe being emptied of the soil core;

FIG. 3 is a side view of the pipe apparatus according to the subject invention;

FIG. 4 is a partial cross section along the lines 4—4 in FIG. 3;

FIG. 5 is a plan view of a detail of a first embodiment of an extension apparatus according to the subject invention;

FIG. 6 is a side view of the apparatus shown in FIG. 5;

FIG. 7 is a view along the line 7—7 in FIG. 6.

FIG. 8 is a view along the line 8—8 in FIG. 6.

FIG. 9 is a side view of a detail of a second embodiment of extension apparatus according to the invention.

FIG. 10 is a top view of the apparatus shown in FIG. 9.

The advantages of the present invention will become apparent to those skilled in this art from the following detailed description, wherein I have described only the preferred embodiments of the invention, simply by way of illustration of the best modes contemplated by me of carrying out my invention. As will be realized, the invention is capable of other and different embodiments, and its several details are capable of modification in various obvious respects, all without departing from the invention. Accordingly, the drawings and description are to be regarded as illustrative in nature, and not as restrictive.

DETAILED DESCRIPTION OF THE PRESENTLY PREFERRED EMBODIMENTS

FIGS. 1 and 2 may be used to describe the subject method in broad outline. As shown therein, a rotary cab, crawler-type backhoe 10 is positioned on a road 12 transverse to its length. Although not shown, it is contemplated that smaller, tractor-type backhoes can be used for small diameter coring operations. Ditches 14 have been dug on either side of the road 12. A pipeline, such as a water main, is being laid in the ditch and the roadway 12 must be crossed. Since the steps for laying the pipeline in the excavated ditches 14 are conventional and do not form a part of the invention per se, they are neither illustrated nor described in detail. The soil beneath the road 12 is assumed to be plastic, by which is meant soil, such as clay, which may be tunneled without use of drills or explosives, and which will hold their shape (at least temporarily) after tunneling without the use of internal supports.

Apparatus according to the subject invention comprises a tunneling pipe 16 and a cutting head 18 mounted on one end of the pipe 16. Both will be described in detail later, but it is enough for now to state that the cutting head 18 has an inner diameter which is less than the inner diameter of the pipe 16 and an outer diameter which is greater than the outer diameter of the pipe 16 (see FIG. 3).

The method comprises the steps of driving the pipe 16 into the soil, cutting head first, while providing a low volume, lubricating flow of water on both the outside and the inside of the pipe 16 adjacent to the cutting head 18, then withdrawing the pipe 16 from the soil in the opposite direction to the direction in which it was inserted, raising and swinging the pipe to the dumping position and suspending the pipe 16 in the air with the cutting head 18 uppermost in order to allow the soil within the pipe 16 to slide out. After the first insertion, the process is repeated (using, for example, the pipe extension techniques described hereinafter with reference to FIGS. 5–10) until the tunnel has been cut to the required length.

The apparatus used in performing the subject process is simple, inexpensive and sturdy in use. As shown in FIGS. 3 and 4, the cutting head 18 is preferably removably mounted on the pipe 16, as by one or more bolts 20 held in place by washers 22 and nuts 24, permitting the cutting head 18 to be easily removed for sharpening or replacement. The working face of the cutting head 18 is preferably beveled outwardly at 26, as best seen in FIG.

4, to force the annular ring of soil displaced by the cutting head outwardly, thereby compacting the walls of the tunnel for greater holding strength and leaving the removed core substantially uncompacted for easy dumping. The cutting head 18 itself is preferably fabricated from an outer mounting ring 28 fitting over the pipe 16 and an inner cutter ring 30. The peripheral rear shoulder of the cutter ring abuts the axially outer face of the pipe 16 to efficiently receive the driving force of the pipe 16.

The lubricating flow of water is provided by a water pipe 32, which can be mounted on either the inside or the outside of the pipe 16 but which is most conveniently mounted on the outside, as shown. The axially inner end of the water pipe 32 is tapered to provide minimum driving resistance and apertured behind the taper at 34 to provide a lubricating flow of water on the outside of the pipe 16. The water pipe 32 has aperture 36 to communicate with a matching hole 38 in the pipe 16 to provide a lubricating flow of water on the opposite or inside of the pipe 16. Although not strictly necessary, a distribution collar (not shown) could be provided on either the outside or the inside of the pipe 16 to circumferentially distribute water from the water pipe 32 around the circumference of the pipe 16. Similarly, the water pipe 32 could be extended if desired in order to provide a flow of lubricating water at the working face of the cutting head 18. Furthermore, the inside of the pipe 16 can be lubricated with an additional lubricant, such as motor oil, prior to use, but neither expedient has been found necessary in practice in most cases. The low volume flow does not in any way dislodge the dirt as in the prior art methods; the object being simply to lubricate the pipe surfaces and help form a solid, plasterlike supporting skin on the inner cylindrical surface of the tunnel.

The means for driving the pipe 16 into the soil is preferably extremely simple. As illustrated in FIG. 1, the means may simply comprise the backhoe 10, the digging bucket of the backhoe being placed against the driving end of the pipe 16 to force it into the ground. Other, more elaborate techniques may also be used, particularly where the ground is unusually hard, as may be desired.

The means for driving and withdrawing the pipe 16 from the soil can conveniently comprise a lug 40 mounted on the pipe 16 at its axially outer end and a wire rope sling 42 with quick disconnect shackles connecting the lug 40 to the bucket of the backhoe 10. Then, when it is desired to withdraw the pipe 16 from the soil, the hoe is simply extended and the pipe is slid out of the ground, its exit being facilitated by the slick and compacted surface of the tunnel T, shown in FIG. 2. The lug 40 has a notch 41 to receive the lip of the hoe bucket to prevent inadvertent slipping during the pushing operation.

Next the pipe is removed from the ditch 14 by connecting the sling to center pickup lug 45 and raising the pipe 16, preferably to the working level for the operator. The pipe is swung to the selected dumping position, the pipe is lowered to the ground and the sling is removed in readiness for suspending the pipe for the dumping operation.

The means for suspending the pipe 16 in the air to allow the soil to slide out can conveniently comprise a suspension lug 44 mounted on the pipe 16 at its axially inner end and the same sling 42 connection allows the suspension of lug 44 to the backhoe 10. While it would, of course, be possible to suspend the pipe 16 in the air by retraction lug 40, in practice it has been found most preferable to disconnect the sling 42 from the retraction lug 40 once the pipe 16 has been withdrawn from the ground and to reconnect it to the pickup lug 4 and then the suspension lug 44. When the pipe 16 is suspended with its cutting head 18 uppermost, the soil slides out much more easily since it is exiting without having to move back across the cutter head, which is smaller in diameter than the soil core. The dirt adjacent the inside of the pipe 16 is compacted and is never required with my method to reverse direction during dumping, and then there is no tendency to bind as the particles or clumps do not dislodge or try to relocate in a mass. As the core of dirt slides in the same direction during dumping, there are no such disruptions and the method and apparatus efficiency is enhanced.

Hydraulic or air driven vibrating devices may be attached to the pipe in a similar manner to the lubrication pipe 32 to facilitate pushing larger pipe sizes, and to help with pushing and dumping in certain soil conditions.

As previously stated, if the tunnel has not been cut to the required length by one insertion of the pipe 16, the process is repeated. Once the pipe 16 has been driven into the ground its full length, it is necessary to provide additional means for driving it further into the soil. Conveniently, such means can be additional lengths of pipe temporarily connected to the pipe 16. One convenient way of making this connection is shown in FIGS. 5–8, and another way is shown in FIGS. 9 and 10.

In the embodiment shown in FIGS. 5–8, the second pipe 46 in the string is smaller (by a standard increment) in outer diameter than the pipe 16, and a plurality of stepped connectors 48 having radially spaced webs 49 are provided to hold the pipes together. Conveniently, the connectors 48 are permanently mounted to one of the pipes, as by welding, and at least some of them are releasably attached to the other pipe, as by headed, quick release pins 50 in oversized holes. The holes receiving the pins are oversized to facilitate quick removal, are 60° apart and the pins are held in by gravity.

In this embodiment, the rear end of the larger lead cutter pipe 16 is mated with the forward end of the smaller extension pipe 46. As an example, if a ten inch cutter pipe 16 is being used, an eight inch pusher pipe 46 is used having the adapter structure just described carried on its mating end. The mating can occur after the cutter pipe 16 has been driven all the way back into the ground. The beveled edges of the connectors guide the pipes together and the pins 50 are simply dropped into place to lock the assembly together. The driving of the pipes and the tunneling process is then resumed. Of course, the pipe 46 is provided with a driving and retraction lug (not shown) and a suspension lug (also not shown).

In the embodiment shown in FIGS. 9 and 10, the second pipe 52 in the assembly is selected to have the same outer diameter as the pipe 16, and the pipes are held together by a sleeve 54 which closely fits around the abutting ends of the two pipes. A tie rod 56 is bolted at one end to the driving and retraction lug of the pipe 16 and at the other end to lug 58 of the pipe 52.

FIGS. 9 and 10 also illustrate another feature of the subject invention which is independent of the connection feature just drscribed. That feature is anti-friction rings 60. One of these rings may be provided at the axially outer end of the pipe 16 and additional ones may be provided at the ends of the pipe 52 and any subsequent pipes. The anti-friction rings 60 preferably have outer diameters at least approximately equal to the outer diameter of the cutting head 18. They serve to support the pipes on which they are mounted and to space them from the walls of the tunnel to minimize the sliding friction.

In accordance with the broader aspect of the present invention, rings similar to the anti-friction rings 60 may be used as the cutting means for the lead end of the pipe 16. These rings would serve the same inner and outer compressing function and generally operate satisfactorily.

While the present invention has been illustrated by a detailed description of the preferred embodiments thereof it will be obvious to those skilled in the art that various changes in form and detail can be made therein without departing from the true scope of the invention. For that reason, the invention must be measured by the claims appended hereto and not by the foregoing preferred embodiments.

What is claimed is:

1. A method of cutting a tunnel in plastic soil using an apparatus comprising a pipe and cutting means mounted on one end of said pipe, said method comprising the steps of:

(a) driving said pipe into plastic soil, cutting means first;

(b) withdrawing said pipe from the plastic soil in the opposite direction to the direction in which it was inserted; and then (c) suspending said pipe in the air with the cutting means uppermost to allow the soil within said pipe to slide out.

2. A method as recited in claim 1 wherein is further provided the step of supplying a lubricating flow of water to the rear of the working face of said cutting means.

3. A method as recited in claim 1 wherein said pipe is moved to a dumping location by suspending the same from approximately the center of gravity of said pipe.

4. Apparatus for cutting a tunnel in plastic soil, said apparatus comprising:

(a) a pipe;

(b) cutting means mounted on one end of said pipe;

(c) means for driving said pipe into plastic soil, cutting means first;

(d) means for withdrawing said pipe from the plastic soil in the opposite direction to the direction in which it was inserted; and (e) means coupled to said pipe adjacent to said cutting means for suspending said pipe in the air with the cutting means uppermost in order to allow the soild within said pipe to slide out.

5. Apparatus as recited in claim 4 wherein said cutting means comprises a head removably mounted on said pipe having an inner diameter which is less than the inner diameter of said pipe and an outer diameter which is greater than the outer diameter of said pipe.

6. Apparatus as recited in claim 5 wherein the working face of said cutting head is beveled outwardly.

7. Apparatus as recited in claim 5 and further comprising means for connecting said pipe to a further pipe in axial alignment therewith in order to drive said pipe into the plastic soil by a distance exceeding the length of said pipe.

8. Apparatus as recited in claim 5 and further comprising an anti-friction ring mounted on the end of said pipe remote from said cutting head.

9. Apparatus as recited in claim 8 wherein the outer diameter of said anti-friction ring is at least approximately equal to the outer diameter of said cutting head.

10. Apparatus as recited in claim 4 and further comprising means for providing a lubricating flow of water on both the outside and the inside of said pipe adjacent to said cutting means.

* * * * *